United States Patent [19]

Kelsall

[11] 4,232,361

[45] Nov. 4, 1980

[54] ADJUSTABLE LIGHT FIXTURE

[75] Inventor: Jeffrey C. Kelsall, Streamwood, Ill.

[73] Assignee: McGraw-Edison Company, Rolling Meadows, Ill.

[21] Appl. No.: 967,367

[22] Filed: Dec. 7, 1978

[51] Int. Cl.[3] ..... F21V 21/04

[52] U.S. Cl. ..... 362/364; 362/269; 362/285; 362/404

[58] Field of Search ..... 362/147, 148, 150, 269, 362/285, 364, 365, 366, 368, 370, 371, 372, 404, 405, 406, 408, 419

[56] References Cited

U.S. PATENT DOCUMENTS

| | | | |
|---|---|---|---|
| 510,317 | 12/1893 | Berry . | |
| 1,249,389 | 12/1917 | Harter . | |
| 1,529,266 | 3/1925 | Mersing . | |
| 1,972,056 | 8/1934 | Saaf . | |
| 1,975,282 | 10/1934 | Mageoch . | |
| 1,985,582 | 12/1934 | Schwinger | 362/404 |
| 2,649,535 | 8/1953 | Feder . | |
| 2,782,295 | 2/1957 | Schwenkler . | |
| 2,826,684 | 3/1958 | Baker . | |
| 2,855,503 | 10/1958 | Gerstel . | |
| 2,922,030 | 1/1960 | Bobrick . | |
| 3,018,364 | 1/1962 | Wenman . | |
| 3,286,090 | 11/1966 | Brown | 362/364 |
| 3,313,931 | 4/1967 | Klugman | 362/364 |
| 3,316,399 | 4/1967 | Totten | 362/364 |
| 3,518,420 | 6/1970 | Kripp | 362/364 |
| 3,660,651 | 5/1972 | Miles . | |
| 3,778,609 | 12/1973 | Liberman . | |
| 3,912,865 | 10/1975 | Seebinger . | |
| 3,974,371 | 8/1976 | Miles . | |

*Primary Examiner*—L. T. Hix
*Assistant Examiner*—Alan Mathews
*Attorney, Agent, or Firm*—Ronald J. LaPorte; Bruce R. Mansfield; Jon C. Gealow

[57] ABSTRACT

An adjustable light fixture recessible in a ceiling for directing light at various angles includes a housing with a lamp assembly mounted therein. The lamp assembly comprises a reflector having a conventional bulb socket attached pivotally to a plate having spaced apertures. Resilient tracks, mounted at one end to the base of the housing are received in the apertures provided in the plate, rendering the plate slidable along such tracks. The tracks are each provided with a series of protrusions engagable with rollers each of which are mounted on the plate adjacent the spaced apertures to form a series of overcenter arrangements whereby the position of the plate and the lamp assembly may be adjusted. Stops are provided at the free end of each track to limit the movement of the lamp assembly therealong. However, the stops may be bypassed to permit complete removal of the lamp assembly from the housing.

5 Claims, 7 Drawing Figures

ADJUSTABLE LIGHT FIXTURE

BACKGROUND OF THE INVENTION

This invention relates generally to recessed light fixtures and more particularly to such fixtures which include a lamp assembly movable into and out of a recessed fixture housing to direct light at various angles.

Light fixtures which can be recessed in the ceiling of a room and which include a lamp assembly movable to various positions inside and outside of the fixture housing for directing light in many directions, are well known in the art. Examples of such light fixtures are shown in U.S. Pat. Nos. 3,660,651; 3,974,371; and 3,778,609.

The light fixtures illustrated in the U.S. Pat. Nos. 3,660,651 and 3,974,371 each include a cylindrical housing which is recessible in a ceiling, which may be either of the permanent or suspended type. A lamp assembly, including a shade and socket, is mounted on a yoke and U-shaped bracket combination for pivotal and rotational movement. An extendable toggle arm arrangement mounts the lamp assembly to the cylindrical housing. The toggle arm arrangement permits the lamp shade to be moved to various positions within the cylindrical housing for directing light at various angles therefrom or to be withdrawn from the cylindrical housing to provide additional lighting effects.

While the above-described light fixtures provide adjustment of the lamp assembly for directing light at various angles and permit movement of the shade into and out of of the fixture housing, the toggle arm arrangement is relatively complex requiring, for instance, a plurality of arm segments which are bolted together and two brackets bolted to the side wall of the housing.

The light fixture of the U.S. Pat. No. 3,778,609 also includes a cylindrical housing which is recessible in the ceiling and includes a lamp assembly including a shade. A bracket fastened to the shade secures the latter to an arcuate track fixed in the housing. The shade is thereby slidable along the track between positions inside and outside of the housing.

The last-mentioned light fixture while being of simpler construction than those prior art fixtures described heretofore, is not as versatile, since it appears that the lamp assembly is movable only along the fixed track. Thus, no pivotal or rotational movement of the lamp assembly whether within or without the housing is possible.

Other types of light fixtures which provide for adjustment of a lamp or socket vertically with respect to a mounting bracket are known in the art. For instance the fixture of the U.S. Pat. No. 1,972,056 includes a pair of strap-like resilient arms which extend vertically downwardly from a mounting bushing or the like for engaging a lamp socket. A metal ring or plate on which the lamp socket is fixed includes slots through which the resilient arms pass. The slots are of generally trapezoidal configuration having an inner longer parallel side and an outer shorter parallel side. The resilient arms, which extend normal to the plate, are of a slightly lesser width than the wider inner slot side and have opposed pairs of notches at their edges for outward lateral movement toward the outer, narrow slot side. These notches are provided at spaced intervals along the length of the resilient arms.

In use, the metal plate is movable along the resilient arms to various vertical positions with respect to a reflector surrounding the socket. The metal plate is positionable along the arms and can be locked into position at the various notched locations by the receipt of the notched section of the arms in the reduced width portion of corresponding slots in the plate. To adjust the position of the lamp socket, the lower ends of the arms must be moved together to release the locked plate for movement along the arms.

While the arrangement of U.S. Pat. No. 1,972,056 permits a lamp socket to be moved to various vertical positions with respect to a surrounding reflector, it appears that unlocking of the slotted plate from a locked position on the resilient arms is complex, requiring the arms to be moved together to withdraw them from the narrowed portion of the slots and thereafter sliding the plate to which the socket is fastened along the arms, while the arms are held in such position.

SUMMARY OF THE INVENTION

Accordingly, it is a primary object of the present invention to provide a recessed light fixture including a new and improved arrangement for mounting a lamp assembly in a fixture housing which arrangement permits the lamp assembly to be moved easily and quickly to various positions inside and outside the housing for directing light at various angles therefrom.

It is another object of the present invention to provide a light fixture of the above-described type which is relatively simple in construction, yet overcomes the drawbacks of the prior art lamp fixtures described heretofore.

A preferred embodiment of a light fixture according to the invention comprises an outer cylindrical housing, closed at one end, and open at the other, which is recessible in a ceiling, either of the permanent or suspended type. Three flat resilient tracks are each attached at one end of the inner surface of the closed end of the housing. The tracks are spaced 120° apart, and extend downwardly through the interior of the housing in a spaced relation from the side wall thereof. Each of the tracks has a substantially vertical portion and a free end portion extending downwardly and outwardly toward the side wall of the housing. Each track has a series of raised areas or protrusions formed in spaced relation along the outwardly facing surface of the track with detents, or valleys formed between adjacent protrusions.

A lamp assembly receivable in the recessed housing includes a lamp socket and a reflector mounted on a yoke which is coupled to one surface of a support plate. Three openings, each of a size sufficient to receive one of the tracks, are provided in the support plate.

Each track is resilient, being formed of spring steel, and extends in its relaxed position downwardly and outwardly from its upper end which is secured to a mounting plate. Thus, as each track is urged inwardly from its relaxed position, it assumes an outward bias. The protrusions and detents formed on the outwardly facing surface of each track are thereby outwardly biased when the track on which they are formed is urged inwardly from its normal or relaxed position.

To mount the lamp assembly in the fixture housing, each track is urged inwardly, and inserted through an opening in the support plate. Detent engaging means such as rollers are mounted on the support plate near each opening for engagement with the outwardly biased track at points between the protrusions located thereon. The lamp assembly may be positioned by moving it in the desired direction, and when so moved, the rollers mounted on the support plate travel along the outer surfaces of the tracks, with each protrusion of the tracks outwardly biased and forming an overcenter arrangement with the roller. Thus, a series of detents or valleys formed between adjacent protrusions is defined for receiving its associated roller or detent engaging means. Each roller, within limits, can be positioned independently, thereby allowing the support plate, and hence the lamp assembly, to be tilted at angles to the horizontal. The resilient tracks are mounted for rotational movement, allowing the lamp assembly to be rotated about the vertical axis of the housing.

Other objects and further details of that which is believed to be novel in the invention will be clear from the following description and claims taken with the accompanying drawings which illustrate a preferred embodiment of the subject invention.

DESCRIPTION OF THE PREFERRED EMBODIMENT

Figure 1:
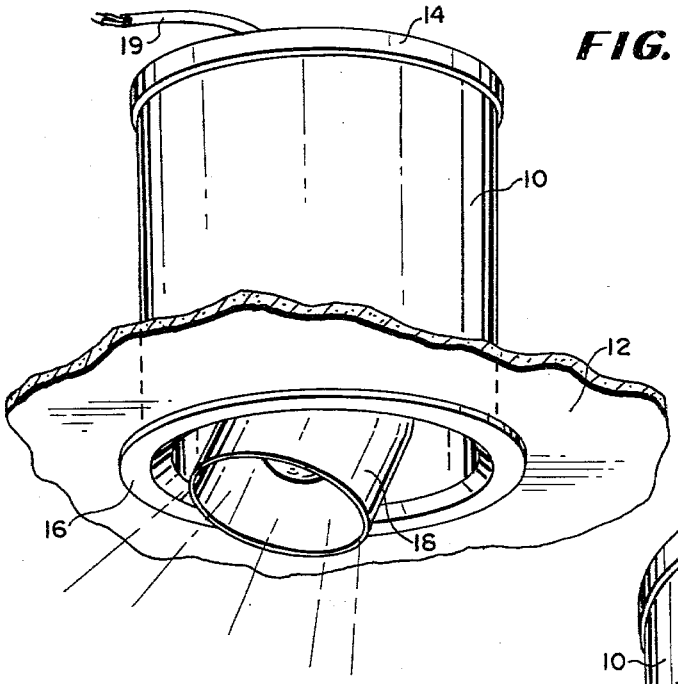
FIG. 1 is a perspective view of a recessed light fixture according to the invention, shown mounted in a ceiling.

Referring now to FIG. 1, one form of a light fixture according to the present invention is shown. The light fixture includes a cylindrical housing 10 recessed in a ceiling 12. An end wall 14 encloses the recessed end of housing 10, and a trim ring 16 surrounds the open end. Light reflector 18 is upwardly and downwardly movable with respect to housing 10, and is mounted for rotation about a vertical axis. Electrical lead wires 19 connect the lamp to an external source of electrical power, not shown in the drawings.

Figure 2:
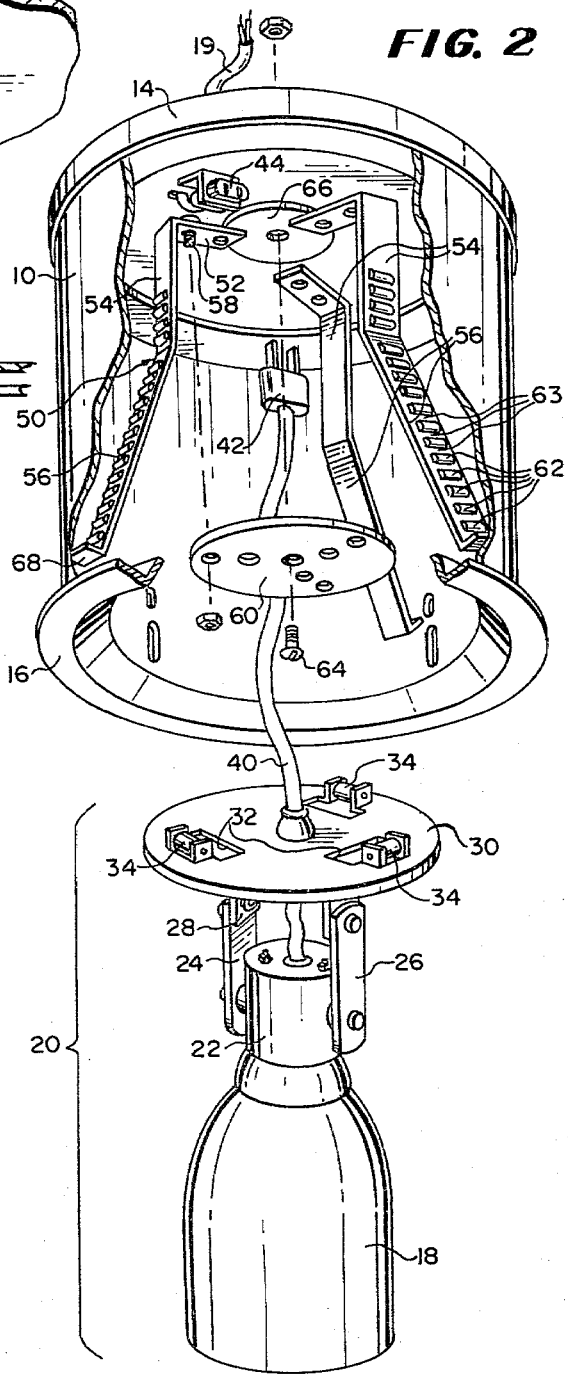
FIG. 2 is a partially broken away, exploded view of the light fixture of FIG. 1.

Turning now to FIG. 2, a lamp assembly, designated generally by the numeral 20, is mounted for movement with respect to housing 10. The lamp assembly 20 includes a conventional light bulb socket, not shown in the drawings, contained within a reflector 18. The reflector 18 is provided with a base 22 pivotally connected to a pair of support arms 24, 26, each of which is attached to a support plate 30. The support arms 24, 26 may be fixedly mounted directly to support plate 30. If greater adjustment of the lamp assembly is required, arms 24, 26 may be pivotally connected to the legs of a U-shaped bracket or yoke 28, fixedly mounted on support plate 30, as is shown in the drawings. If adjustment about the central axis of the housing 10 is required, yoke 28 may be rotatably mounted on plate 30. Openings 32 of a predetermined dimension are formed in plate 30, and rollers 34 are provided adjacent each opening 32 on the top surface of plate 30.

A power cord 40 extends through plate 30 and terminates in a separable male connector 42. A corresponding female connector 44, coupled via lead wires 19 to a source of power (not shown), is mounted on the end wall 14 of housing 10. Power cord 40 is of sufficient length to permit movement of lamp assembly 20 within housing 10, and the separable connection provided by connectors 42, 44 as well as the length of power cord 40 allows removal of lamp assembly 20 from housing 10.

Figure 3:
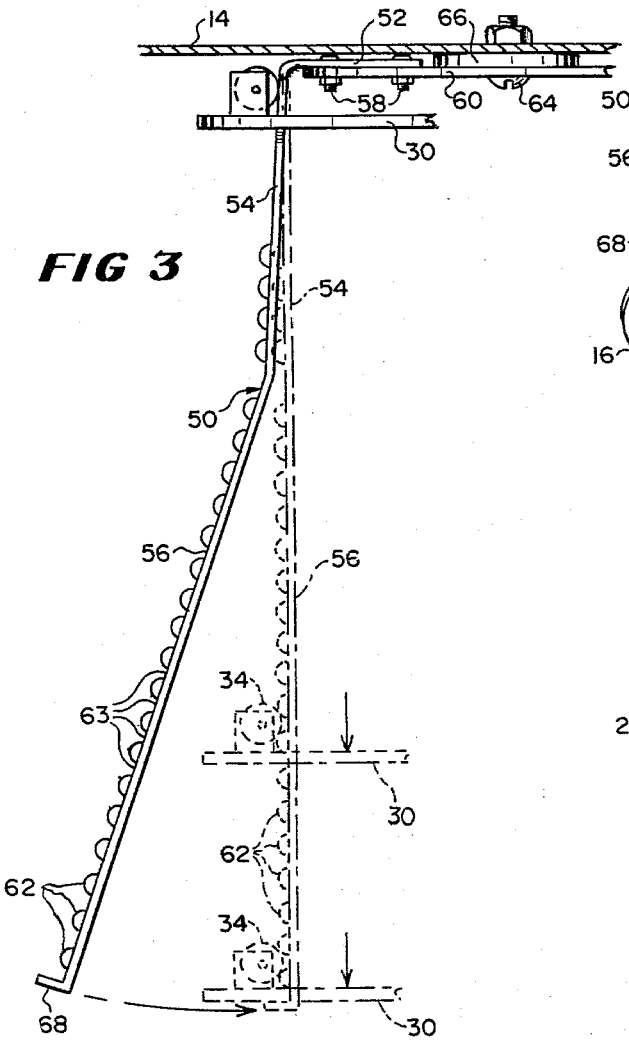
FIG. 3 is an enlarged partial side view of one of the plurality of support tracks and of a portion of the lamp assembly support plate of the light fixture of FIG. 2.

Referring now to FIGS. 2 and 3, it will be noted that three generally rectangular elongated tracks 50, formed from spring steel or other suitable material are provided in housing 10. Tracks 50 serve to mount lamp assembly 20 in a variety of positions both within and outside of housing 10. Each track 50 is formed with three portions designated by the numerals 52, 54, and 56. The first portion 52 of each track 50 extends parallel to end wall 14 of housing 10, and is attached to a mounting plate 60 by bolts 58 which extend through aligned holes in portion 52 and mounting plate 60. The second portion 54 of tracks 50 extends downwardly from plate 60 in a direction generally parallel to the sidewall of housing 10. The third portion 56 of track 50, is inclined relative to second portion 54 so as to diverge outwardly and downwardly with respect thereto. A series of spaced protrusions 62 is provided along sections 54 and 56 of tracks 50. These protrusions have a width corresponding approximately to the length of the rollers 34 on support plate 30, and are generally arcuate in a cross-section taken along the length of tracks 50. Interposed between protrusions 62 are valleys or detents 63. The assembly of plate 60 and tracks 50 is rotatably mounted to end wall 14 by a bolt 64 which extends through apertures in the centers of plate 60 and end wall 14, respectively. A washer 66, positioned between plate 60 and end wall 14, spaces track portion 52 from end wall 14 and provides easy rotation of the track assembly within housing 10.

To mount the lamp assembly 20 in housing 10, resilient tracks 50 are urged inwardly to align the free ends of the tracks with the openings 32 in plate 30. As the tracks are urged inwardly from their relaxed outwardly diverging configuration, an outward bias force is established along track sections 54 and 56 imparting an outward bias to each protrusion 62 and detent 63 located thereon. The track ends are then inserted into openings 32 and released so that the outer surfaces of tracks 50, along which detents 63 are provided, are engaged by the detent engaging means or rollers 34. Plate 30 is thereby selectively positionable along sections 54 and 56.

Stop members 68 are provided at the free ends of tracks 50 to limit the travel of plate 30 therealong, thereby preventing disengagement of plate 30 from tracks 50. In the preferred embodiment, stop means 68 are formed by bending a predetermined length of the free end of tracks 50 outwardly. Openings 32 are rectangular, and are dimensioned to allow stop means 68 and tracks 50 to be passed therethrough. Thus, owing to the corresponding configurations of stop means 68 and openings 32, removal of lamp assembly 20 from housing 10 is accomplished by drawing resilient tracks 50 inwardly, and passing plate 30 downwardly over the ends of tracks 50.

Figure 4:
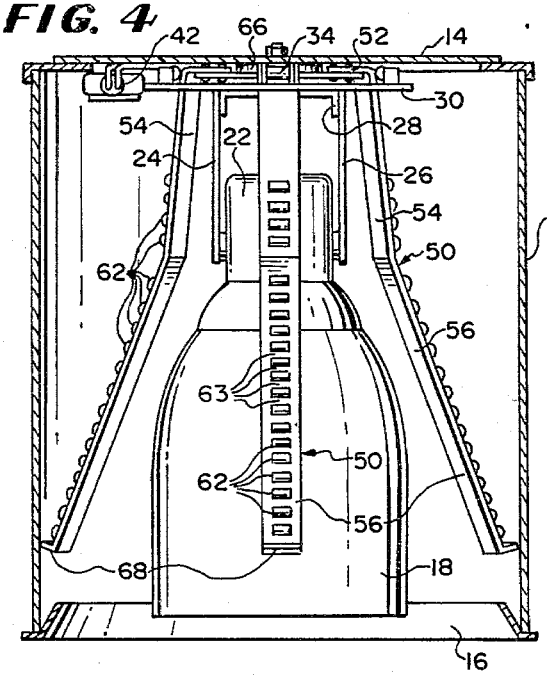
FIGS. 4–7 are side sectional views of the light fixture of FIG. 1 illustrating some of the various positions to which the lamp assembly may be moved.
Figure 5:
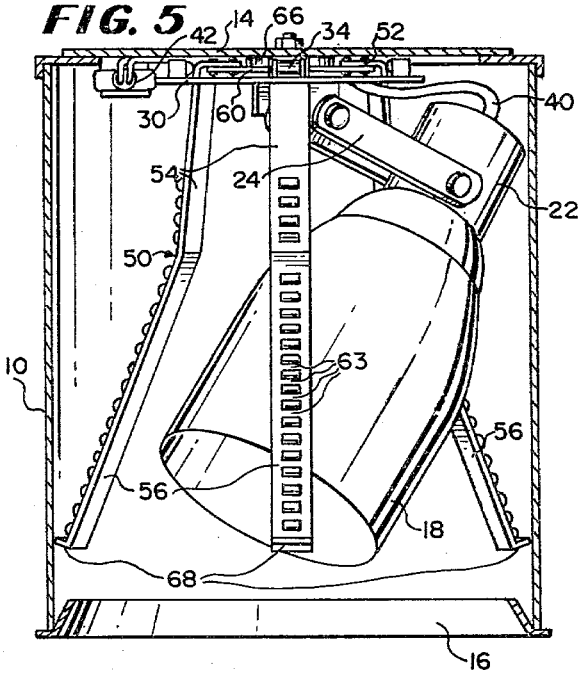
Figure 6:
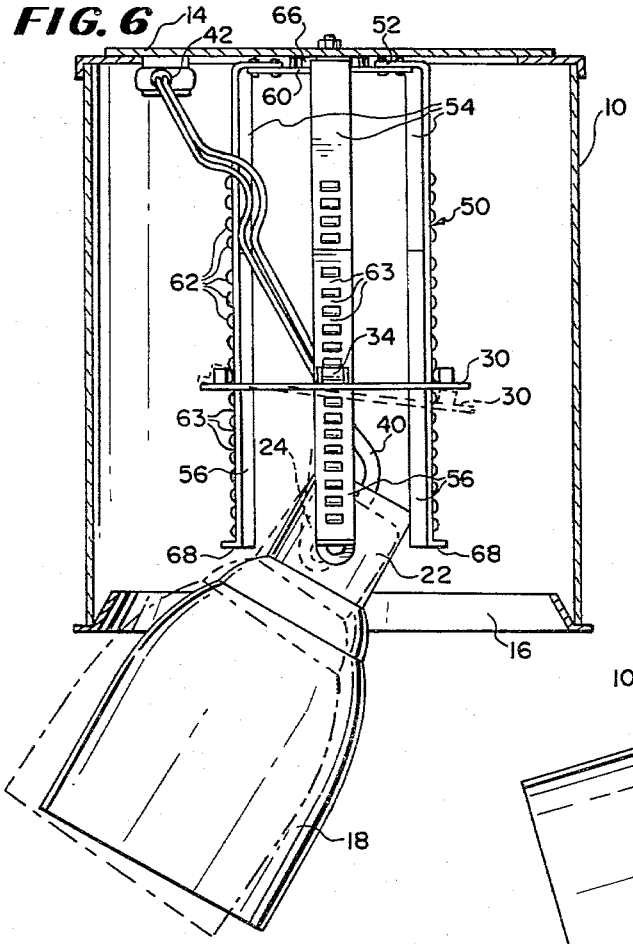

Referring now to FIGS. 3–7, operation of the light fixture according to the present invention will be described. FIG. 4 shows the lamp assembly 20 being positioned as far into the housing 10 as is possible. To reposition the lamp assembly without changing the position of plate 30 along tracks 50, the user merely moves the open end of reflector 18. With the support plate 30 in its innermost position, the lamp assembly can be swung to one side, as is shown in FIG. 5. In this, as in other positions, the lamp assembly can be rotated about the axis of housing 10, since plate 60 to which tracks 50 are mounted, is free to rotate thereabout. Yoke 28 could also be rotatably mounted on support plate 30.

A downward pull on reflector 18 effects downward movement of support plat 30 along tracks 50, which are held in positive contact with rollers 34 by the outwardly biased portions 54, 56. Referring to FIG. 3, it can be seen that as support plate 30 traverses a downward path along tracks 50, rollers 34 encounter a continuous succession of outwardly biased protrusions 62 and detents 63. The protrusions are spaced apart to allow rollers 34 to be received, or cradled in detents 63 located between adjacent protrusions 62. As shown by the phantom portion of FIG. 3, each protrusion 62, formed on outwardly biased track portions 54, 56 comprises an overcenter arrangement with rollers 34. To explain, as roller 34 begins to travel over each protrusion 62, a resistance is encountered until the roller is positioned at the apex of protrusion 62. When this point is passed, the roller snaps into a stable position in the valleys or detents 63 formed between adjacent protrusions. In the preferred embodiment, the diameter of roller 34 is more than twice the length of the flat spaces between protrusions 62. The points of contact between the roller 34 and each two adjacent protrusions are positioned approximately 60°, but no more than 160° apart on the circumference of roller 34. As a result, when roller 34 snaps into position between adjacent protrusions 62, the roller assumes a secure resting position. A series of positive vertical adjustments is thereby provided by the reception of the roller member in one of a series of valleys formed between adjacent protrusions. It wil be seen by those skilled in the art that adjustments to the relative size of the protrusions 62, the spacing between protrusions, and the curvature of slidable surfaces or rollers 34 will determine not only the degree of stability of the roller 34 when seated, but also the amount of effort required to urge rollers 34 over succeeding protrusions 62. As shown in the phantom portion of FIG. 6, support plate 30, and hence lamp assembly 20, can be tilted with respect to the horizontal plane by selectively moving one roller 34. If greater tilt is required, reflector 18 can be tilted with respect to yoke 28.

Inasmuch as the protrusions 62 raised above the track 50 form valleys or detents 63 for receiving a roller 34, this track arrangement could be substituted with a flat track, not shown, having depressions formed beneath its surface providing a detent for receiving a roller, pad or other slidable surface. In this alternative embodiment, a sufficiently small spacing between rounded depressions provides a series of detents formed between overcenter arrangements which urge the roller to snap into adjoining detents or depressions. In another alternative to the arrangement of roller and protrusions referred to above, the tracks are provided with a series of holes or apertures spaced close together, so that the remaining portion of track between apertures forms an overcenter arrangement for urging a captive bearing ball or other detent engaging means having a slidable surface to be received in the detents or apertures.

Figure 7:
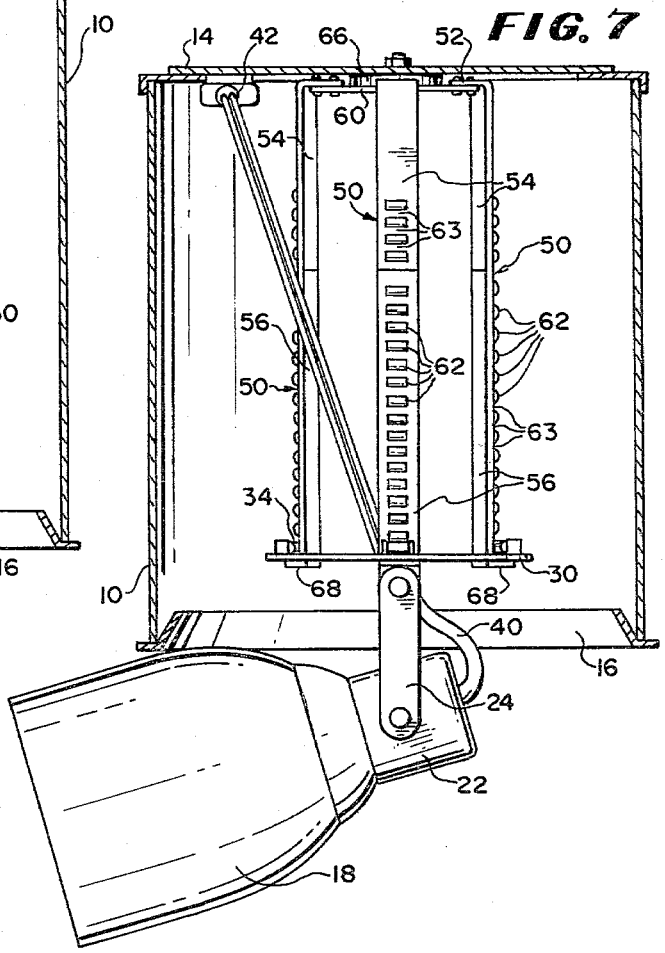

As is shown in FIG. 7, tracks 50 extend nearly the entire length of housing 10, allowing lamp assembly 20 to be positioned virtually entirely outside of housing 10. Stops 68 limit the movement of plate 50 of lamp assembly 20 to prevent unintentional disengagement of the plate from tracks 50. To completely remove lamp assembly 20 from housing 10, one need only draw the lamp assembly downwardly, disconnect connectors 42, 44, and urge tracks 50 inwardly to clear stops 68 from openings 32 in plate 30.

It can be seen therefore that Applicant's overcenter arrangement provides a means for easily and positively positioning lamp assembly 20 to a variety of orientations both within and outside of recessed housing 10. Other embodiments of the invention will be apparent to those skilled in the art, and it is intended to cover by the appended claims all embodiments falling within the scope thereof.

I claim:

1. A lighting fixture comprising:

a hollow elongated housing having an open end and a closed end;

a plurality of elongated tracks mounted at one end to the closed end of said housing, a series of spaced protrusions disposed along said tracks;

a support plate receivable within said housing and movable along said tracks;

lamp assembly means mounted on said support plate;

rollers mounted on said support plate for engaging said protrusions;

said tracks being resilient and extending downwardly from the closed end of said housing and outwardly from the central axis of said housing, said tracks assuming a bias in a direction transverse to their length when deflected toward the central axis of said housing whereby said series of protrusions and said rollers form a series of overcenter arrangements with each of said rollers selectively engagable between adjacent ones of said protrusions in response to the application of a positioning force to one of said plate and lamp assembly means.

2. A lighting fixture comprising:

mounting means for supporting said fixture;

a plurality of elongated tracks, each being mounted at one end to said mounting means, said tracks biased for movement in directions transverse to their length;

detent means, including protrusions, serially disposed along said tracks;

a support member for supporting a lamp assembly, said support member being provided with a plurality of detent engaging means; and rollers provided on said support member, said protrusions and rollers forming a series of overcenter arrangements, said rollers engagable between adjacent ones of said protrusions, said protrusions and said rollers being operable to engage each other to selectively position said lamp assembly with respect to said mounting means in response to the adjustment.

3. A light fixture comprising:

a hollow, elongated housing having an open end and a closed end;

a plurality of spaced-apart, resilient, elongated tracks mounted at one end to the closed end of said housing, a series of camming surfaces disposed along said tracks;

a support member including a plate receivable within said housing for telescopic and tilting movement with respect thereto;

lamp assembly means mounted on said support member;

a plurality of predeterminedly spaced-apart cam engaging means mounted on said support member for engaging said camming surfaces disposed along said tracks;

said one end of said tracks spaced-apart from each other a predetermined distance corresponding generally to the predetermined spacing of said cam engaging means, said tracks diverging downwardly and being biased outwardly, terminating at free ends;

said support member and said cam engaging means defining a plurality of apertures for receiving respective ones of said tracks, allowing said tracks to telescope through said apertures; and said tracks deflected toward each other, against said outward bias when telescoped through said apertures, whereby said series of camming surfaces and said cam engaging means form a series of overcenter arrangements with each of said camming surfaces selectively engagable between said adjacent ones of said cam engaging means in response to the movement of said support member in said housing along said tracks.

4. The lighting fixture of claim 3 wherein said cam engaging means comprise roller means.

5. The light fixture of claim 3 wherein said camming surfaces include detent means defined on said tracks.

* * * * *